US005222369A

United States Patent [19]

Hancock et al.

[11] Patent Number: 5,222,369

[45] Date of Patent: Jun. 29, 1993

[54] REFRIGERANT RECOVERY DEVICE WITH VACUUM OPERATED CHECK VALVE

[75] Inventors: John P. Hancock; Ralph A. McClelland; Jeffrey S. James, all of Indianapolis, Ind.

[73] Assignee: K-Whit Tools, Inc., Fishers, Ind.

[21] Appl. No.: 815,481

[22] Filed: Dec. 31, 1991

[51] Int. Cl.[5] ..... F25B 45/00

[52] U.S. Cl. ..... 62/149; 62/292

[58] Field of Search ..... 62/77, 85, 149, 292, 62/475, 195; 137/907; 141/2, 18, 21, 65

[56] References Cited

U.S. PATENT DOCUMENTS

| | | |
|---|---|---|
| Re. 32,451 | 7/1987 | Proctor . |
| Re. 33,312 | 5/1990 | Lower . |
| 1,938,205 | 12/1933 | Yeomans . |
| 2,044,096 | 6/1936 | Moran . |
| 2,321,964 | 6/1943 | Zieber . |
| 2,341,429 | 2/1944 | Elsey . |
| 2,341,430 | 2/1944 | Elsey . |
| 2,511,967 | 6/1950 | Campbell . |
| 2,577,598 | 12/1951 | Zwickle . |
| 2,590,061 | 3/1952 | Ash . |
| 2,865,442 | 12/1958 | Halford . |
| 2,917,110 | 12/1959 | Brohl . |
| 2,972,235 | 2/1961 | Smith . |
| 2,986,894 | 6/1961 | Endress . |
| 3,131,548 | 5/1964 | Chubb et al. . |
| 3,177,680 | 4/1965 | Rasovich et al. . |
| 3,232,070 | 2/1966 | Sparano . |
| 3,357,197 | 12/1967 | Massengale . |
| 3,478,529 | 11/1969 | Boykin . |
| 3,729,949 | 5/1973 | Talbot . |
| 3,811,291 | 5/1974 | Schibbye . |
| 3,872,687 | 3/1975 | Bottrum et al. . |
| 3,874,192 | 4/1975 | Kato . |
| 3,915,857 | 10/1975 | Olson . |
| 3,978,685 | 9/1976 | Taylor . |
| 4,110,998 | 9/1978 | Owen . |
| 4,236,381 | 12/1980 | Imral et al. . |
| 4,261,178 | 4/1981 | Cain . |
| 4,285,206 | 8/1981 | Koser . |
| 4,304,102 | 12/1981 | Gray . |
| 4,363,222 | 12/1982 | Cain . |
| 4,364,236 | 12/1982 | Lower . |
| 4,441,330 | 4/1984 | Lower . |
| 4,456,149 | 6/1984 | Sciortino . |
| 4,470,265 | 9/1984 | Correla . |
| 4,476,688 | 10/1984 | Goddard ..... 62/149 |
| 4,480,446 | 11/1984 | Margulefsky . |
| 4,513,578 | 4/1985 | Proctor . |
| 4,523,897 | 6/1985 | Lower . |
| 4,537,038 | 8/1985 | Alsenz et al. . |
| 4,539,817 | 9/1985 | Staggs . |
| 4,554,792 | 11/1985 | Margulefsky . |
| 4,614,231 | 9/1986 | Proctor . |
| 4,624,112 | 11/1986 | Proctor . |

(List continued on next page.)

FOREIGN PATENT DOCUMENTS

| | | |
|---|---|---|
| 0071062 | 2/1983 | European Pat. Off. . |
| 0313079 | 4/1989 | European Pat. Off. . |
| 2056646A | 3/1991 | United Kingdom . |

OTHER PUBLICATIONS

U.S. Ser. No. 07/579,779 filed Sep. 1990, Hancock & McClelland.

*Primary Examiner*—John M. Sollecito

*Attorney, Agent, or Firm*—Ice Miller Donadio & Ryan

[57] ABSTRACT

A device is disclosed for recovering refrigerant from a refrigeration system. The refrigerant recovery device includes a refrigerant processing flow path. The refrigerant processing flow path includes components for withdrawing the refrigerant from the refrigeration system and for processing the refrigerant so removed to remove impurities from the refrigerant. A receiver tank is provided for receiving and storing the processed refrigerant. The receiver tank includes an inlet and an outlet. Components are also provided for transferring the refrigerant from the receiver tank to a transfer tank at an initially evacuated condition, and for preventing the transfer of refrigerant between the receiver tank and the transfer tank when the transfer tank is not in an initially substantially evacuated condition.

19 Claims, 5 Drawing Sheets

U.S. PATENT DOCUMENTS 4,646,527 3/1987 Taylor ..... 62/292
4,688,388 8/1987 Lower .
4,766,733 8/1988 Scuderi .
4,768,347 9/1988 Manz .
4,798,055 1/1989 Murray .
4,805,416 2/1989 Manz .
4,809,520 3/1989 Manz .
4,862,699 9/1989 Lounis .
4,878,356 11/1989 Punches .
4,903,499 2/1990 Merritt .
4,909,042 3/1990 Proctor .
4,916,915 4/1990 Flinchbaugh .
4,934,390 6/1990 Sapp .
4,938,031 7/1990 Manz .
4,939,905 7/1990 Manz .
4,942,741 7/1990 Hancock et al. .
5,005,375 4/1991 Manz et al. .
5,036,675 8/1991 Anderson .
5,042,271 8/1991 Manz .
5,168,721 12/1992 Hancock et al. .

REFRIGERANT RECOVERY DEVICE WITH VACUUM OPERATED CHECK VALVE

FIELD OF THE INVENTION

The present invention relates to a device for use in connection with a mechanical refrigeration system, and more particularly to a device for recovering refrigerant from a mechanical refrigeration system, processing the refrigerant so recovered to remove contaminants therefrom, and storing the processed refrigerant.

BACKGROUND OF THE INVENTION

A wide variety of mechanical refrigeration systems are currently in use in a wide variety of applications. Those familiar with mechanical refrigeration systems recognize that such systems require servicing periodically. This servicing often takes the form of the addition of refrigerant into the system to replace refrigerant which has escaped from the system. Before adding refrigerant, it is often necessary to evacuate the refrigerant remaining in the system. Typically, this remaining refrigerant is removed by bleeding the refrigerant off to the atmosphere.

In recent years, much concern has arisen about this practice of releasing fluorocarbon based refrigerants into the atmosphere. It is believed that the release of such fluorocarbons depletes the concentration of ozone in the atmosphere. This depletion of the ozone layer is believed to adversely impact the environment and human health.

To avoid releasing fluorocarbons into the atmosphere, devices have been constructed that are designed to recover the refrigerant from the refrigeration system. These refrigerant recovery devices often include means for processing the refrigerant so recovered so that the refrigerant can be reused.

Currently, several companies are involved in the manufacture and development of refrigerant recovery devices. These companies include K-WHIT TOOLS, INC., the assignee of the instant application, the ROBINAIR MANUFACTURING CORPORATION (later known as KENT-MOORE CORPORATION), THE DRAF TOOL CO., INC., and the MURRY CORPORATION.

Examples of products developed by K-WHIT TOOLS, INC., include the devices disclosed in U.S. Pat. No. 4,942,741 and U.S. patent application Ser. Nos. 07/579,779, and 07/676,740 both of which were invented by two of the inventors of the instant application, John P. Hancock and Ralph A. McClelland. Examples of devices originating from ROBINAIR include those shown in Cain U.S. Pat. No. 4,261,178; Cain U.S. Pat. No. 4,363,222; Lower, et al. U.S. Pat. No. 4,441,330; Manz, et al. U.S. Pat. Nos. 4,768,347; 4,805,416; 4,809,520; and 4,938,031; and Punches et al U.S. Pat. No. 4,878,356.

An example of a device developed by DRAF TOOLS is shown in Koser U.S. Pat. No. 4,285,206. Koser discloses a device which both reclaims refrigerant, and is capable of providing fresh refrigerant for recharging the refrigeration system once evacuated. An example of a device developed by the MURRAY CORPORATION is shown in Proctor, et al. U.S. Pat. No. 4,909,042.

In addition to those devices developed by the organizations discussed above, several others have developed refrigerant recovery devices. Examples of these other devices are shown in Sparano U.S. Pat. No. 3,232,070; Massengale U.S. Pat. No. 3,357,197; Owen U.S. Pat. No. 4,110,998; Goddard U.S. Pat. No. 4,476,688; Margulefsky et al. U.S. Pat. Nos. 4,480,446 and 4,554,792; Staggs et al. U.S. Pat. No. 4,539,817; Taylor U.S. Pat. No. 4,646,527; and Lounis U.S. Pat. No. 4,862,699.

The patents discussed above are of interest in that they disclose a wide variety of devices for removing refrigerant from a refrigeration system, and processing the refrigerant so recovered. Some of the devices, such as the device shown in Manz et al U.S. Pat. No. 4,805,416 include a recycling loop wherein refrigerant that is withdrawn from a refrigeration system can be recycled through the purification loop of the recovery device to further purify the refrigerant. Other devices such as that shown in Cain U.S. Pat. No. 4,261,178 are primarily "single pass" devices wherein the refrigerant is processed in a single pass of the refrigerant from the refrigeration system, through the device, and into the storage or disposal tank.

Although some, if not all of the devices discussed above are capable of removing and processing refrigerant, room for improvement exists. In particular, room for improvement exists in producing a more simple device which performs its intended function and which can be packaged in a small, hand carried unit which can be carried easily into homes and commercial facilities to service refrigerators and freezers. Another area for improvement resides in providing a device which includes an inboard storage container which can transfer the contents of the inboard container to a detachable refrigerant container.

It is therefore one object of the present invention to provide a refrigerant recovery device that provides a relatively simple, yet effective means for recovering refrigerant from a refrigeration system, and processing the refrigerant so recovered.

SUMMARY OF THE INVENTION

In accordance with the present invention, a device is provided for recovering refrigerant from a refrigeration system. The refrigerant recovery device comprises a refrigerant processing flow path means. The refrigerant processing flow path means includes the withdrawing means for withdrawing refrigerant from the refrigeration system, and a processing means for processing the refrigerant so removed to remove impurities from the refrigerant. A receiver tank means is provided for receiving and storing the processed refrigerant. The receiver tank means includes an inlet and an outlet. A transfer means is provided for transferring refrigerant from the receiver tank means to a transfer tank means at an initially substantially evacuated condition, and for preventing the transfer of refrigerant between the receiver tank means and the transfer tank means when a transfer tank means is not in an initially substantially evacuated condition.

Preferably, the transfer means includes a fluid flow path means for placing the receiver tank in fluid communication with the transfer tank means, and a pressure transfer flow path means for placing the processing flow path means in fluid communication with the fluid path means. A pressure actuated valve means is provided which has a first portion in fluid communication with the pressure transfer flow path means and a second portion in fluid communication with the fluid flow path means. The pressure actuatable valve means is moveable between an open position to permit the flow of fluid between the receiver tank means and the transfer means, and a closed position wherein the flow of fluid between the receiver tank means and the transfer tank means is prevented.

One feature of the present invention is that the device of the present invention utilizes a small, generally permanently affixed inboard tank for storing refrigerant evacuated from the refrigeration device to be serviced. Additionally, a transfer means is provided for transferring the refrigerant from the inboard receiver tank to an outboard transfer tank. This feature has the advantage of helping to make the device more compact, and hence easier for the service technician to transport to the site of the refrigeration system to be serviced. This compact feature of the device is especially helpful for the servicing of appliances having refrigeration systems such as refrigerators and freezers. As will be appreciated, refrigerators and freezers are often located in homes and office buildings Servicing a refrigerator in such a location often requires the service technician to transport the device a substantial distance from his truck to the site at which the refrigerator is placed. As will also be appreciated, homes and office buildings are often not easily accessible to large bulky devices, even if those larger devices are moveable on wheeled carts.

The transfer means has the advantage of enabling the technician to transfer the refrigerant stored in the receiver tank to a separable, external transfer tank. The transfer tank can then be used to transport the refrigerant to a service center for further processing or repackaging. Alternately, the transfer tank can be used to transport the refrigerant to a refrigerant charging device, wherein the refrigerant contained within the transfer tank can be reintroduced into the same, or another refrigeration system.

Another feature of the present invention is that transfer means are provided which permit the transfer of a refrigerant within the interior receiver tank only to a substantially evacuated transfer tank, and which prevents the transfer of a refrigerant from the inboard receiver tank to a transfer tank which is not substantially evacuated. Typically, such a transfer tank would not be substantially evacuated if the transfer tank contains a substantial amount of refrigerant. This feature has the advantage of helping to make the device more safe by helping to reduce or eliminate the problems associated with a service technician mistakenly coupling a partially full or full transfer tank to the device.

It is well known in the refrigeration recovery art that it is preferable to avoid a situation wherein a refrigerant storage tank becomes "overfull." To this end, most practitioners within the industry consider a refrigerant holding tank (such as the transger tank or inboard receiver tank) to be full when liquid refrigerant fills 80% of the internal volume of the tank. Over full tanks should be avoided as they increase the likelihood of tank failure resulting from an inability of the tank to withstand the stress imposed by the pressures exerted by the refrigerant contained within the tank.

It will also be appreciated that if a fluid communication link were established between two tanks, and if the first tank were at a greater pressure than the second tank, that refrigerant would likely flow from the first tank to the second tank.

The transfer means of the present invention helps to obviate the potential for problems resulting from refrigerant within a highly pressurized full transfer tank being introduced into the inboard receiver tank of the device, and thus creating an over pressure situation. Reciprocally, the transfer means of the present invention also has the advantage of preventing refrigerant within a highly pressurized receiver tank from entering into a transfer tank, which was too full to have the capacity to receive the refrigerant flowing from the receiver tank.

Additional features and advantages of the present invention will become apparent to those skilled in the art upon consideration of the following detailed description of a preferred embodiment exemplifying the best mode of carrying out the invention as perceived presently.

DETAILED DESCRIPTION OF PREFERRED EMBODIMENTS

Figure 1:
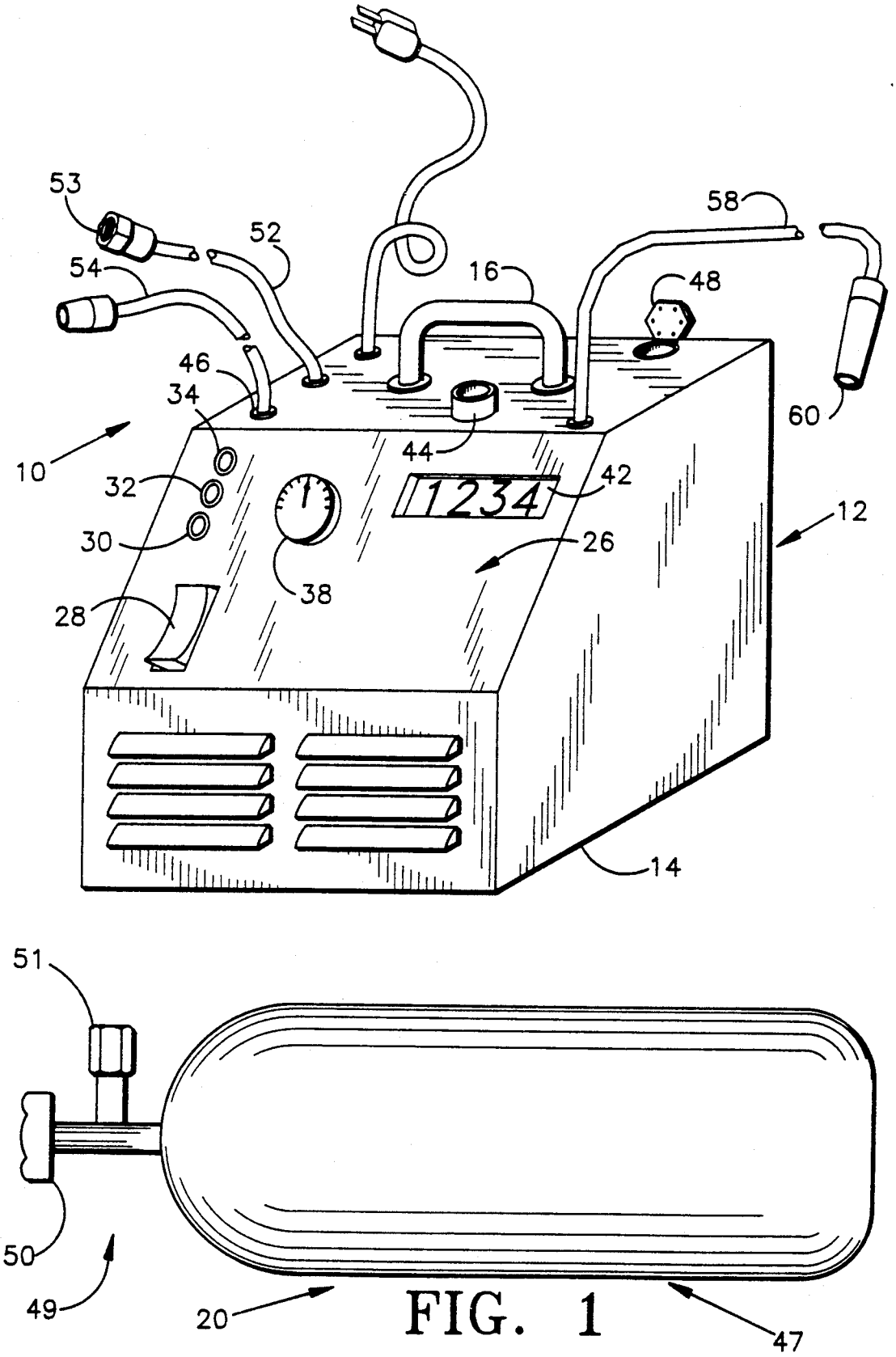
FIG. 1 is a perspective view of the refrigerant recovery device of the present invention.

A refrigerant recovery device 10 is shown in FIG. 1 as including a generally upright metal frame 12 having a base 14 for supporting the device 10 on the ground or on a table top. A top mounted, suitcase-type handle 16 is coupled to the frame 12 to permit the device 10 to be carried into a building or home for servicing a refrigeration system such as a home refrigerator/freezer.

Preferably, the device 10 is designed to be sufficiently small and lightweight to be carried easily by a service person into a house or commercial establishment, wherein the service person can service a refrigerator or freezer within the house or commercial establishment. In a preferred embodiment of the device 10, the device has a length of about 9 inches (22.86 cm) a width of about 10 inches, (25.4 cm) a height of about 9.5 inches, (24.13 cm) and weighs about 9 pounds (15.9 kg).

The operating components of the device are housed within the frame 12 in the device 10. A control panel 26 is disposed on the front surface of the device 10. The control panel 26 includes a rocker type on/off switch 28 for energizing and deenergizing the control circuitry and components of the device 10. A system operating light 30 is also contained on the control panel 26. System operating light 30 is designed to be lighted when the on/off switch 28 is in its on position and the system is operating.

A tank full light 32 is provided for being lighted when the inboard receiver tank 22 (FIG. 2) is full, and a high pressure light 34 is provided for being lighted when an over-pressure condition exists within the device 10. The lighting of the tank full light 32 and high pressure light 34 are usually accompanied by a cessation of operation of the compressor 24 (FIG. 2) of the device 10.

A pressure gauge 38 is provided to enable the user to determine the pressure within the refrigeration system to be evacuated. Additionally, a meter 42 is provided on the control panel 26 for keeping track of the amount of time that the device's compressor 24 has operated. A port 44 is provided through which oil can be added to the compressor 22 when necessary.

An oil purge hose 54 is also provided on top surface of the device 10 Oil purge hose 54 is directly coupled to an air and waste oil purge valve, such as a Schraeder valve 46 that is normally closed. Depression of the oil hose 54 opens the Schraeder valve 46 to allow collected air and separated oil to be purged from the device 10.

The lid 48 of the filter-dryer/oil separator 90 is disposed on the top surface of the refrigerant recovery device 10. The lid 48 is disposed externally of the device 10 to facilitate its removal during the replacement of a filter cartridge 104 within the filter-dryer/oil separator 90. The device 10 is provided with one or more external, detachable transfer tanks, such as transfer tank 20. As will be explained in more detail below, transfer tank 20 is normally not attached or hydraulically coupled to the device 10 during the time that the device 10 is recovering refrigerant from the refrigeration system being serviced. To the contrary, the transfer tank 20 is only coupled to the device 10 when refrigerant is being transferred from the inboard receiver tank 22 to the transfer tank 20. Although transfer tank 20 can assume a wide variety of sizes and configurations, typically transfer tank 20 will comprise a small, hand holdable tank 20 capable of holding approximately 2 pounds (0.91 kg) of refrigerant.

Transfer tank 20 includes a hollow cylindrical body 47, and a valve assembly 49. Valve assembly 49 includes a hand-actuable valve 50, and a port coupling 51. Port coupling 51 preferably comprises an anti-blowback valve type blocking valve coupling of the type first invented by Kenneth White, the president of the Assignee of the instant patent application. Anti-blow back valve of this type have been used commercially and sold by the Assignee since at least the early 1970s.

The device 10 also includes a plurality of hoses. The hoses enable the device 10 to be coupled in fluid communication to the refrigeration system 72 to be serviced, and to the transfer tank 20. The hoses include a low side refrigerant hose 52 having an anti-blowback type blocking valve connector member 53 disposed at its distal end. Blocking valve connector member 53 couples hose 52 to the low side refrigerant port of the refrigeration system 72 to be serviced.

Blocking valve connector member 53 is designed so that the flow of gas and liquid through the connecting member 53 is normally blocked. However, the blocking valve connector member 53 opens to allow the passage of refrigerant therethrough when attached to the port of the refrigeration system 72.

The second hose 58 contained on the device 10 comprises a refrigerant delivery hose 58 which includes a blocking valve connector member 60 at its distal end. Anti-blowback type blocking valve connector member 60 is coupled to port coupling 51 of the transfer tank 20. Blocking valve connector member 60 is designed to be matable with port coupling 51.

A third hose functions as an oil dump hose 54. Oil dump hose 54 extends from the Schraeder valve 46, and is provided for transferring purged air, and oil from the device 10, and particularly from the sump of the filter-dryer/oil separator 90. The distal end of the oil dump hose 54 can feed the purged water and oil into an appropriate waste oil container (not shown).

Figure 2:
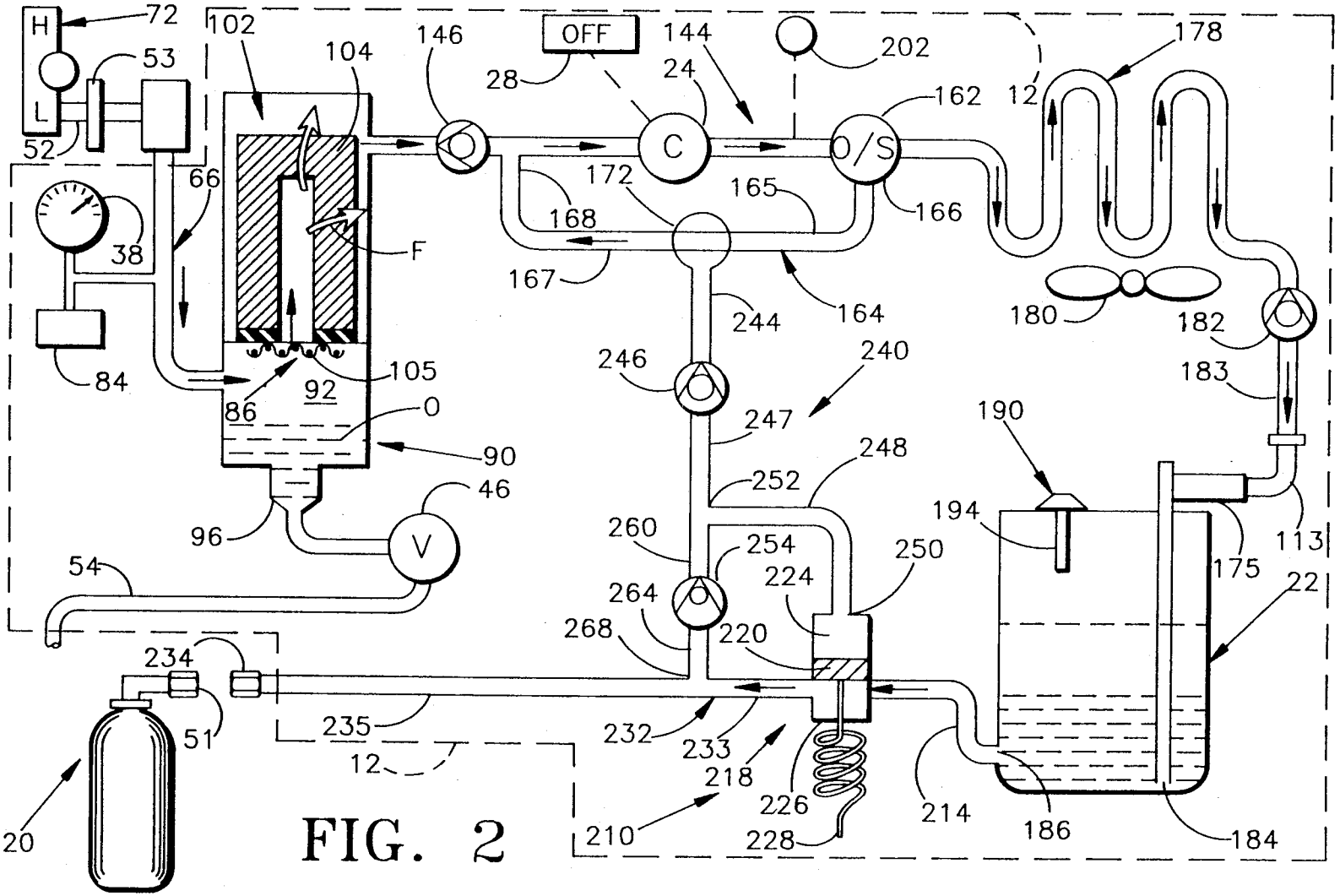
FIG. 2 is a schematic view of the components of the refrigerant recovery device in an "off" or non-operating mode.

The operating components and refrigerant flow path are best shown in FIG. 2.

The device 10 is shown in FIG. 2 as being coupled to a refrigeration system 72 to be serviced through the low side refrigerant hose 52. Refrigeration system 72 can take the form of a refrigerator, air conditioner, heat pump, or other mechanical refrigeration system. Refrigeration system 72 includes a compressor, a high pressure port H disposed downstream from the compressor, and a low pressure port L disposed upstream the compressor. The high and low pressure ports H, L provide ports through which refrigerant can be added or removed from the refrigeration system 72. The low side refrigerant hose 52 of the device 10 is coupled through blocking valve connector member 53 to the low pressure port L of the refrigeration system 72.

As will be described in more detail below, the device includes a primary refrigerant processing flow path through which the refrigerant flows when it is withdrawn from the refrigerant system 72 to be serviced. The primary function of the primary refrigerant flow path and its associated components is to withdraw refrigerant from refrigeration system 72 to be serviced, and to process the refrigerant so withdrawn to remove impurities, such as air, water, and oil from the refrigerant. The primary components of the primary refrigerant flow path are the filter-dryer/oil separator 90, the compressor 24, the oil return loop/64, the second oil separator 162, and the condenser 178.

The device 10 also includes a pressure gauge 38 and a vacuum switch 84 which are disposed upstream from the filter-dryer/oil separator 90. The vacuum switch 84 and the pressure gauge 38 are configured to be responsive to the pressure of the refrigeration system 72 to be serviced. The vacuum pressure switch 84 will cause the device 10 to cease operation upon sensing a vacuum in the refrigeration system 72. The sensing of such a vacuum indicates that all refrigerant has been recovered from the refrigeration system 72. An example of a commercially available pressure gauge is a gauge manufactured by AMETEK. Preferably vacuum pressure switch 84 is a model 20PS028ECV06V14C vacuum switch manufactured by TEXAS INSTRUMENTS of Dallas, Tex., and is designed to be actuated to open at pressures less than 5 inches Hg.

The filter-dryer/oil separator (FDOS) 90 includes an inlet 86 disposed downstream of the low side refrigerant hose 52. The inlet 86 opens into a first, or lower chamber portion 92 of the FDOS 90. The lower chamber portion 92 comprises the oil separator portion of the FDOS 90. Lower portion 92 has generally cylindrical sidewalls, and a hemispherical bottom portion 109 which serves as a sump for storing oil removed from recovered refrigerant. A purge port 96 is disposed at the bottom of the lower chamber 92, through which separated oil O and separated air can be removed. Purge port 96 terminates at its distal end in the Schraeder valve type purge valve 46. Schraeder valve 46 is operatively coupled to purge valve button 45 (FIG. 1), and is in fluid communication with dump hose 54. The Schraeder valve 98 controls the flow of air and oil through the purge port 96.

The FDOS 90 also includes a second, or upper chamber portion 102. Second chamber portion 102 is provided for containing a filter element 104, and comprises the filter-dryer portion of the canister 90. A screen 105 is disposed between the first chamber portion 92 and the second chamber portion 102 so that all refrigerant passing from the first portion 92 into the second portion 102 must pass through the screen 105. Preferably, screen 105 is a 100 mesh screen that is designed to help trap particulate matter. Additionally, screen 105 provides a surface which fosters the condensation of oil droplets in the refrigerant passing therethrough.

Refrigerant flowing into the lower chamber 92 will tend to evaporate into its vaporous form. Additionally, oil contaminants contained within the refrigerant will tend to precipitate out of the refrigerant, coalesce into droplets, and fall into the bottom of lower chamber 92 adjacent to purge port 96. The FDOS also includes a refrigerant outlet 126 through which filtered refrigerant can flow out of second chamber 102.

The FDOS includes a generally circular, radially inwardly extending interior flange upon which the filter cartridge 104 rests. A circular flat gasket is placed between the flange and the filter cartridge 104 to sealingly engage the filter 104 to the flange. This sealing engagement between the filter 104 and the flange forces refrigerant to flow through the filter 104, and prevents flow around the filter cartridge 104.

The filter cartridge 104 has the shape of an inverted cup. The purpose of the filter cartridge 104 is to filter out both particulate matter and water from the refrigerant passing therethrough. An example of a filter cartridge 104 which will function in connection with the present invention is the RC 039 model filter cartridge manufactured by SPORLAN VALVE CO.

Refrigerant flowing out of the FDOS 90 flows into the primary flow path 144 of the device 10. A first, primary flow path (PFP) check valve 146 is disposed downstream from the FDOS 90 outlet 126. The first PFP check valve 146 is biased to allow refrigerant to move in the direction indicated by the arrows from the FDOS 90 toward the compressor 24, but to prevent refrigerant flow in an opposite direction through the primary flow path 144.

The compressor 24 is disposed downstream of the first PFP check valve 146. An example of a compressor that functions with the instant invention is a 0.1 horsepower compressor manufactured by a variety of compressor manufacturers.

A high pressure sensor and switch arrangement 202 are disposed downstream of the compressor 24, and upstream of the second oil separator 162. The high pressure sensor senses the pressure downstream from the compressor 24. If the pressure sensed by high pressure sensor is too high, the high pressure switch will stop operation of the compressor 24 to allow the pressure within the device 10 to become reduced to a lower, and hence safer level. Preferably, the high pressure sensor and switch 202 are set to shut off the compressor 24 if the high pressure sensor senses a pressure in excess of 405 PSIG. Commercially available high pressure cut-off switches of the type described are available from TEXAS INSTRUMENTS CORPORATION of Dallas, Tex.

A second oil separator 162 is disposed downstream from the compressor 24. An oil return loop 164 has its first, or upstream end 166 disposed at the downstream side of the oil separator 162. The second or downstream end 168 of the oil return loop 164 is disposed upstream from the compressor 24. A three way valve 172 is also contained within the oil return loop 164. The operation of the three-way valve 172 will be explained in more detail below.

The oil return loop 164 contains an upstream segment 165 which extends between the upstream end 166 of the oil return loop 164 and the three way valve 172. The oil return loop also contains a downstream segment 167 which extends between the three way valve 172 and the downstream end 168 of the oil return loop 164.

The operation of the compressor 24 causes oil to be depleted from the compressor 24, and to be added to the refrigerant exiting from the compressor 24. The second oil separator 162, removes this added oil, and returns it via the oil return loop 164 to the compressor 24 to replenish the oil lost from the compressor 24. An example of a commercially available "second" oil separator is the Model 5-5920I Oil Separator manufactured by AC & R Componants, Inc.

The three way valve 172 controls the flow of oil back to the compressor. The operation of the three way valve 172 is controlled largely by on-off switch 28, to which the three way valve 172 is operatively coupled.

When the recovery system within the device 10 is not operating, the three way valve 172 is biased to permit fluid to flow through the three way valve 172 between the upstream oil return loop segment 165 and the downstream oil return loop segment 167, thus permitting refrigerant, (and oil) to flow freely within the oil return loop 164. By permitting this flow of fluid, the pressure on the upstream side of the compressor 24 becomes balanced with the pressure on the downstream side of the compressor 24 when the system 10 is not operating. This balanced pressure condition on both the upstream and downstream side of the compressor 24 facilitates the start up of the compressor 24 when a new refrigerant recovery cycle commences.

A condenser 178 is disposed downstream of the second oil separator 162. Condenser 178 can be a six foot (1.83 m) coiled restrictor tube having a 0.083 inch inner diameter. A fan 180 is disposed adjacent to the condenser 178 to help remove heat from the condenser 178.

A second PFP check valve 182 is disposed downstream from the condenser 178, and a refrigerant delivery tube 183 is disposed downstream from the second PFP check valve 182. Refrigerant delivery tube 183 terminates at its distal end in a coupling member 173, which is coupled to an inlet port 175 of the inboard receiver tank 22. The refrigerant inlet port 175 has its opening at lower terminus 184. Terminus 184 is disposed adjacent to the bottom of the inboard receiver tank 22.

The inboard receiver tank 22 is disposed within the device 10, and is designed to remain within the device 10, and not be removed. The inboard receiver tank 22 comprises the primary storage means of the device 10. Refrigerant which is recovered by the device 10 from a refrigeration system 72 is stored in the inboard receiver tank 22, until it is transferred to the transfer tank 20.

The inboard receiver tank 22 is preferably comprised of metal, is generally cylindrical in shape, and has an effective capacity of approximately 2 pounds (1.9 kg) of refrigerant. The construction of the inboard receiver tank 22 should be such so as to withstand the normal stress imposed by the storage of refrigerant under pressure.

The inboard receiver tank 22 includes an exit port 186 disposed adjacent to the bottom of the inboard receiver tank 22 through which refrigerant can be removed from the inboard receiver tank 22. The exit port 186 is placed adjacent to the bottom of the inboard receiver tank 22 to help to ensure that the refrigerant is removed from the inboard receiver tank 22 as primarily liquid phase refrigerant. The inboard receiver tank 22 also includes a liquid level sensor 190. Liquid sensor 190 is provided for sensing the level of refrigerant R within the interior of the inboard receiver tank 22. The sensor 190 is coupled to the control circuitry (not shown) of the device 10. Typically, the sensor 190 will cause the compressor to be shut off in a tank full situation. Additionally, the actuation of the control circuitry by sensor 190 can cause the tank full light 32 to become lit if the sensor 190 senses that the interior receiver tank 22 is full, or a "tank empty" light (not shown) to become lit if the sensor senses that the interior receiver tank 22 is substantially devoid of refrigerant. The liquid level sensor 190 also includes a probe 194 which extends into the interior of the inboard receiver tank 22. Examples of liquid level sensors which will perform with the device of the present invention are shown in White and Hancock U.S. patent application Ser. No. 07/725,834, entitled Liquid Level Sensor for Refrigerant Servicing Device, which was filed on Jul. 3, 1991.

The inboard receiver 22 which is carried within the frame 12 of the device 10 helps to make the device 10 more convenient for the service technician as it enables him to carry one, relatively small, self-contained package into the home or office wherein the refrigerator or air conditioner to be serviced is located. In the present invention, the applicants have coupled the convenience of this inboard receiver tank 22 with an external storage tank 20 to which the refrigerant contained within the inboard receiver tank 22 can be transferred, so that the inboard receiver tank 22 can be emptied, and thus receive further refrigerants from other refrigerators.

Typically, the transfer tank 20 is an evacuated container which withdraws refrigerant from the inboard receiver tank 22 through the pressure differential created by the vacuum of the transfer tank 20.

However, the applicants recognized one potential problem with the use of such a vacuum type transfer tank 20. This potential problem would exist if a full or partially full transfer tank 20 were coupled to the device 10 instead of a transfer tank substantially devoid of refrigerant. If transfer tank 20 contains refrigerant, a likelihood exists that when refrigerant is transfered from the device 10 and inboard receiver tank 22 to transfer tank 20, an excessive amount of refrigerant will be introduced into the tank. The introduction of an excess amount of refrigerant into the transfer tank 20 from the device 10 and in-board receiver tank 22 would have the potential to cause an overfill situation within the transfer tank 20. To avoid the potential for danger inherent in such an over pressure/over fill situation, the applicants have incorporated the pressure transfer and fluid path (PTFP) into the present invention. As will be explained in more detail below, the primary purposes served by the PTFP components of the present invention are two-fold. The first purpose is to provide a path to transfer refrigerant from the inboard receiver tank 22 to the external transfer tank 20. The second purpose is to provide a path and associated componentry which will prevent the introduction of fluid from a partially full or full transfer tank 20 into the device 10, if a partially full transfer tank 20 is inadvertently coupled to the device 10, instead of a fully-evacuated transfer tank 20.

Figure 3:
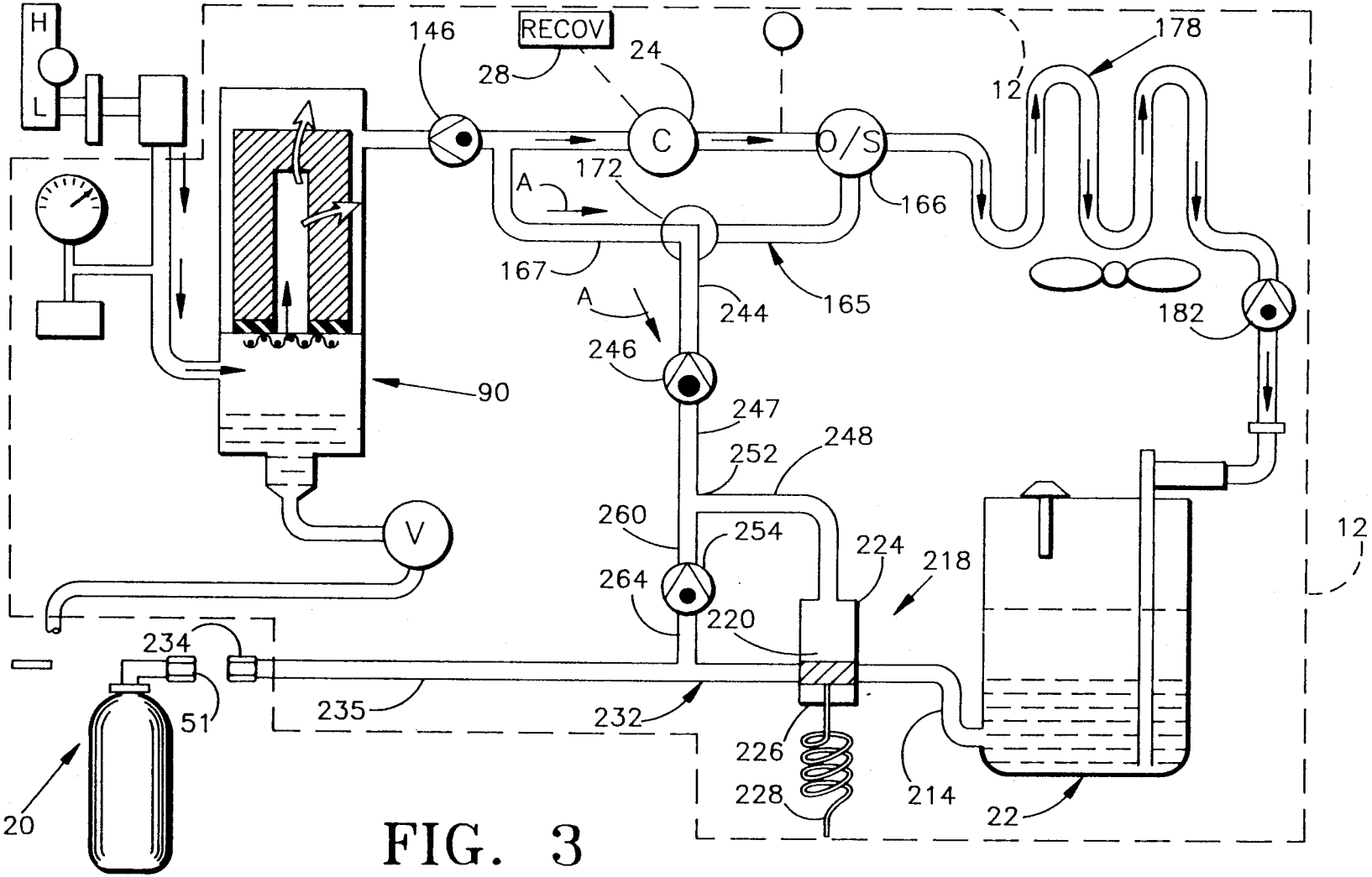
FIG. 3 is a schematic view of the device in a "refrigerant recovery" mode of operation.

The pressure transfer and fluid path 210 includes a first refrigerant transfer tube 214 which extends between the outlet 186 of the inboard receiver tank 22 and a pressure actuated valve 218. Pressure actuated valve 218 is provided for controlling the flow of fluid between first refrigerant transfer tube 214 and second refrigerant transfer tube 232, and ultimately between the inboard receiver tank 22 and the transfer tank 20. The pressure actuated valve 218 includes a moveable plunger 220 which is moveable between an open position (FIG. 2) and a closed position (FIG. 3). In its open position, the plunger 220 permits the flow of fluid between the first refrigerant transfer tube 214 and the second refrigerant transfer tube 232. In its closed position (FIG. 3), the plunger 220 prevents the flow of fluid between the first refrigerant transfer tube 214 and the second refrigerant transfer tube 232. The moveable plunger 220 sealingly engages the side walls of the interior of the valve 218, and defines a first chamber portion 224 and a second chamber portion 226. The plunger 220 prevents the flow of fluid between the first and second chamber portions 224, 226. It will be appreciated that the internal volume of the first chamber portion 224 and the second chamber portion 226 will likely vary depending on whether the plunger 220 is in the open position (FIG. 2) or the closed position (FIG. 3).

A biasing means, here shown as spring 228, is provided for normally biasing the plunger 220 into the open position. When the spring 228 acts to bias the plunger 220 into the open position, fluid is able to flow between the first refrigerant transfer tube 214 and the second refrigerant transfer tube 232. An example of a pressure actuated valve 218 which will function in the present invention is the P1110 model valve manufactured by the Humphrey Products Company.

The second refrigerant transfer tube 232 includes a first segment 233 and a second segment 235. The first segment 233 extends between the pressure actuated valve 218 and a T-connector 268. The second segment 235 extends between the T-connector 268 and the anti blow back type coupling member 234 which is coupled to the distal (outboard) end of second refrigerant transfer tube 232.

The pressure transfer and fluid path 210 described above also includes a pressure transfer flow path portion 240. The pressure transfer flow path is so denominated in this application because, although refrigerant is the primary entity which flows through the various conduits of the pressure transfer flow path 240, the primary purpose for the flow of fluid is to introduce various pressures (or lack of pressures) on various valve components. By the manipulation of these pressures, the flow of fluid through the pressure transfer and fluid path 210 can be controlled advantageously.

The pressure transfer flow path portion 240 includes the first pressure transfer conduit segment 244 which extends between, and is in fluid communication with three-way valve 172 and a first pressure transfer and fluid path (PTFP) check valve 246. First PTFP check valve 246 is configured to only permit the flow of fluid in a direction wherein the fluid flows from first pressure transfer conduit segment 244 to second pressure transfer conduit segment 247. The first PTFP check valve 246 prevents the flow of fluid in the reverse direction. The pressure transfer flow path 240 also includes a third pressure transfer conduit segment 248 which has a first end 250 in fluid communication with the first chamber portion 224 of the pressure actuated valve 218. The other end of the third pressure transfer segment 248 terminates at T-connector 252, which couples the second pressure transfer conduit segment 247 to the third pressure transfer conduit segment 248. The T-connector 252 is also coupled to a fourth pressure transfer conduit segment 260 which extends between the T-connector 252 and the second PTFP check valve 254. Second PTFP check valve 254 is configured so as to only allow the flow of fluid between the fourth pressure transfer conduit segment 260 and the fifth pressure transfer conduit segment 264, and to prevent the flow of fluid in a reverse direction thereto. The fifth pressure transfer conduit segment 264 has its other terminus at T-connector 268 which couples the fifth pressure transfer conduit segment 264 to the second refrigerant transfer tube 232.

The first and second PTFP check valves 246, 254 are both selected so as to open in response to a pressure differential of about three to four PSIG between the upstream and downstream side of the check valves 246, 254. Thus, the first and second PTFP check valves 246, 254 will open not only in response to the exertion of pressure on their upstream side, but also the exertion of a vacuum on their downstream side. However, in either event the flow of fluid through each check valve 246, 254 is permitted only in one direction.

The pressure valve 218 is biased by spring 228 to normally be opened, but is closable under the exertion of pressure generally greater than four or five PSIG.

Turning now to FIG. 2, the operation of the device in its "off" mode of operation will be explained. The configuration of the components shown in FIG. 2 is the configuration one would find the components of the device when the recovery device 10 is not recovering fluid from refrigeration system 72, and the device 10 is turned off. First, it will be noted that the transfer tank 20 is disconnected from the device 10, thereby placing anti-blow back valve couplings 51, 234 not in fluid communication. The compressor 24 is not operating, and thus no refrigerant is drawn from the refrigeration systems 72. First and second PFP check valves 146, 182 are in a closed position. Three-way valve 172 is configured to permit fluid to flow between the upstream segment 165 and downstream segment 167 of the oil return loop 164, to achieve a balanced pressure condition between the upstream and downstream sides of the compressor 24.

Pressure actuated valve 218 is biased to be open to permit any refrigerant in either the inboard receiver tank 22 or the first refrigerant transfer tube 214 to pass freely through the valve 218 to the second refrigerant transfer tube 232. However, any refrigerant in refrigerant transfer tube 232 has little place to go, as the second PTFP check valve 254 prevents the flow of refrigerant from the fifth pressure transfer conduit segment 264 to the fourth pressure transfer conduit segment 260. The anti blow-back valve 234 prevents the refrigerant from escaping out the distal end of the second refrigerant transfer tube 232. The plunger 220 prevents the refrigerant from escaping into the first chamber 224 of the pressure actuated valve 218. Additionally, the second PFP check valve 182 prevents refrigerant from flowing from the refrigerant delivery tube 183 back into the condenser 178. Thus, it will be appreciated that when the device 10 is turned off, the refrigerant is confined within the pressure transfer and fluid path 210 of the device.

The control circuitry for the present invention is generally similar to the control circuitry disclosed in Hancock and McClelland U.S. patent application No. 07/676,740 filed on Mar. 28, 1991.

The operation of the device 10 in its recovery mode of operation will now be described, and can be best understood with reference to FIG. 3.

The device 10 is first properly coupled to the refrigeration system 72 to be serviced and the rocker-type on-off switch 28 is moved to its on position. Assuming that the required conditions are met, the compressor 24 will begin drawing refrigerant out of the refrigeration system 72. Refrigerant will be drawn through the low side pressure hose 52, and will be directed into the lower chamber 92 of the filter dryer/oil separator 90. In the lower chamber 92, any liquid refrigerant will usually evaporate into a gaseous state and oil and water within the refrigerant will tend to become separated from the refrigerant. Any oil drops which coalesce within the chamber 92 interior, or upon screen 105, will generally drop and fall into the lower chamber portion 92. This separated oil can then be purged through the purge port 96, Schaeder-type purge valve 98, and oil dump hose 54.

Evaporated refrigerant from which the oil has been separated then flow through screen 105 into the upper chamber 102 of the filter-dryer/oil separator 90. Refrigerant then flows from the upstream surfaces of the filter cartridge 104, through the filter cartridge 104, and then past the downstream surfaces of the cartridge 104, in the directions indicated generally by arrows F. During the passage of the refrigerant through the filter element 104, particulate matter and moisture is removed from the refrigerant. Thus, refrigerant emerging from the refrigerant outlet 126, and passing into the primary flow path 144 should be in a condition wherein it is substantially devoid of particulants and moisture.

Refrigerant then flows through compressor 24, and through second oil separator 162. Oil separated in second oil separator 162 can be returned to compressor 24 by oil return loop 164. Refrigerant passing through the second oil separator 162 then passes through a condenser 178, wherein the refrigerant begins to condense from its vaporous phase into liquid phase. Ultimately, the refrigerant emerging from condenser 178 passes through second PFP check valve 182 and is delivered by refrigerant delivery hose 58 into the interior of inboard receiver tank 22.

During the recovery mode of operation of the device, the first PFP check valve 146 and second PFP check valve 182 are open due to the influence of the compressor 24 and the respective vacuum and pressure it exerts upon the refrigerant within the system 72. Three-way valve 172 is positioned so as to place downstream segment 167 and first pressure transfer conduit segment 244 in fluid communication, to enable some refrigerant to flow in the direction indicated generally by the arrows A that are shown adjacent to three-way valve 172. Although only a small amount of refrigerant flows through the three-way valve 172, the refrigerant flowing therethrough has enough pressure to cause the first PTFP check valve 246 to open, to thereby allow refrigerant to flow, and pressure to be transferred into the second pressure transfer conduit segment 247, and the fourth pressure transfer conduit segment 260. The pressure exerted in the fourth pressure transfer conduit segment 260 causes second PTFP check valve 254 to open. Additionally, the pressure exerted by the fluid flow in the third pressure transfer conduit segment 248 exerts the pressure against plunger 220 to overcome the normal "open" bias induced by spring 228, to cause the plunger 220 to go into its "closed" position. With plunger 220 of pressure actuated valve 218 in its closed position, fluid cannot pass between the first refrigerant transfer tube 214 and the second refrigerant transfer tube 232. The important ramification of this configuration is that, while the device 10 is recovering refrigerant from a refrigeration system 72, the pressure actuated valve 218 is normally biased to its closed position, thus preventing the escape of refrigerant from the inboard receiver tank 22. It should also be noted that transfer tank 20 is not coupled, and hence, not in fluid communication with the second refrigerant transfer tube 232. When the recovery of refrigerant from the refrigeration system is complete, and the device 10 is shut off, the device will return to the configuration shown in FIG. 2. However, the plunger 220 of the pressure actuated valve 218 will remain in its closed position (as shown in FIG. 3) to prevent the flow of refrigerant from the inboard receiver tank 22 into the second refrigerant transfer tube 232. If subsequent recovery cycles are run without emptying the inboard receiver tank 22, the plunger 220 will remain in its closed position throughout these subsequent cycles.

Figure 4:
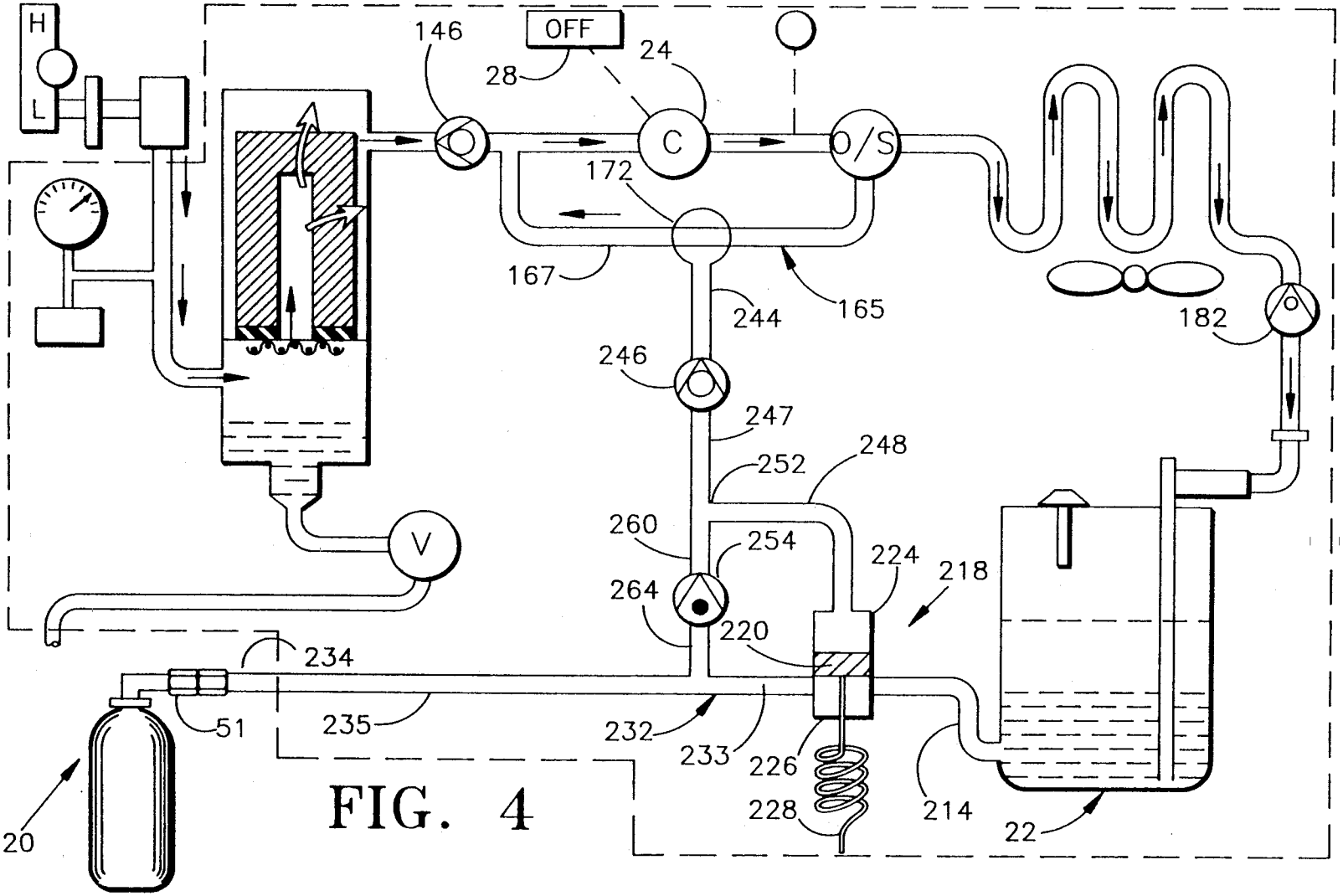
FIG. 4 is a schematic view of the device in a "refrigerant transfer" mode of operation.

The operation of the device in its transfer mode of operation, wherein it is transferring fluid from the inboard receiver tank 22 to the transfer tank 20 is best described with reference to FIG. 4.

In the transfer mode of operation, the on-off button 28 of the device will be placed in its off position, so that the electrical components of the device, such as the compressor 24 are not operating. An evacuated transfer tank 20, which is substantially completely devoid of refrigerant is coupled to the second refrigerant transfer tube 232 by the mating of the anti-blow back couplings 51, 234.

As compressor 24 is turned off, the first and second PFP check valves 146, 182 are placed in their closed position. The three-way valve 172 is placed in its "off position" to put the upstream 165 and downstream 167 segments of the oil return loop 164 in fluid communication, and to block the flow of fluid from either of the upstream 165 or downstream 167 segments of the oil return loop 164 to the first pressure transfer conduit 244.

As set forth above, the transfer tank 20 is evacuated. This evacuation of the transfer tank 220 means that the transfer tank 220 is at a lower pressure than the interior of the second refrigerant conduit 232. The vacuum induced by the transfer tank 20, when coupled to the second refrigerant transfer 232, pulls open second PTFP check valve 254, and draws refrigerant out of the third pressure transfer conduit segment 248. By drawing refrigerant out of third pressure conduit segment 248, refrigerant is withdrawn from the first chamber 224 of the pressure actuable valve 218. This withdrawal of refrigerant from first chamber 228 relieves the pressure on plunger 220, to permit spring 228 to move the plunger 220 into its normally open position. When the plunger 220 is in its open position, refrigerant from the inboard receiver tank 222 can flow through the first refrigerant delivery tube 214 through the valve 218, through the second refrigerant transfer tube 232, through the anti-blow back type couplings 51, 234, and ultimately into the transfer tank 20.

The increase in pressure in the second refrigerant transfer tube 232 may cause the second PTFP check valve 254 to close. However, as the second PTFP check valve 254 will not permit the flow of fluid in a reverse direction, the vacuum induced by the transfer tank 20 to cause the pressure actuable valve 218 to open will remain in tact, and the pressure actuable valve 218 will remain in its open position to permit the free flow of refrigerant therethrough. The vacuum within the transfer tank 220 will continue to draw refrigerant into the transfer tank 20 until the tank 20 is full, or the pressure is otherwise equalized between the transfer tank 20 and the inboard receiver tank 22.

Figure 5:
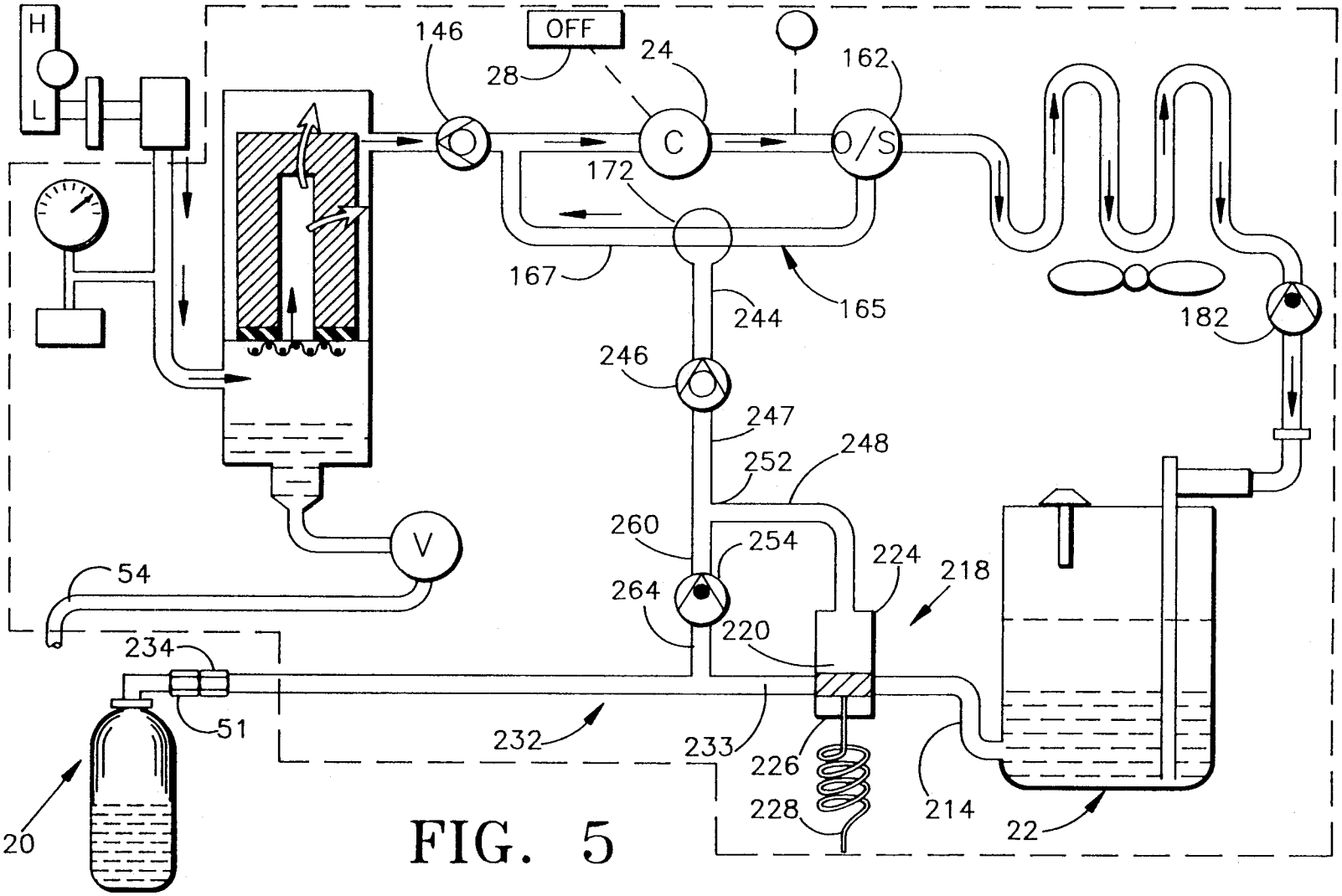
FIG. 5 is a schematic view of the device in a "transfer prevent" mode of operation.

The connection of a partially full transfer tank 20 to the device 10 will now be explained with reference to FIG. 5. As discussed above, it is undesirable to connect a partially full transfer tank 20 to the device, as an overpressure/over fill situation may result within the transfer tank 20. The present invention prevents such a connection of a partially full tank 20 from having any deleterious impact on the tank (or device), or creating such an overpressure/over fill situation within any components of the device 10 or tank which could be adversely affected by such an overpressure situation.

As is the case in all transfer modes of operation, the on-off switch 28 is placed in its off position, so that the compressor 24 is not actuated. First and second PFP check valves 146, 182 are in their closed position, and the three-way valve 172 is in its position wherein it permits fluid to flow between the upstream return loop segment 165 and the downstream return loop segment 167, and prevents the flow of fluid from either segment 165, 167 of the oil return loop into the first pressure transfer conduit segment 244.

As was discussed previously, after the completion of a recovery cycle, the plunger 220 of the pressure actuable valve 218 is in its closed position to prevent the flow of fluid therethrough, between the first refrigerant transfer tube 214 and the second refrigerant transfer tube 232. As refrigerant exists within the transfer tank 20, the coupling of the tank 20 to the second refrigerant transfer tube 232 will not create a vacuum within the second refrigerant transfer tube 232. This failure to create a vacuum within the second refrigerant transfer tube 232 causes second PTFP check valve 254 to remain closed. As such, no refrigerant will flow from the first chamber 224, third pressure transfer conduit segment 248, or fourth pressure transfer conduit segment 260 through the second PTFP check valve 254. Thus, pressure will not be relieved in the first chamber 224 of the valve 218. Consequently, the plunger 220 will remain firmly seated in its closed position.

Thus, any refrigerant within the transfer tank 20 will be confined to the second refrigerant transfer tube 232 and the fifth pressure transfer conduit segment 264. No refrigerant from the transfer tank 220 will be able to pass through the valve 218, and into the inboard receiver tank 22, or travel to other components of the device 10. The partially full transfer tank 20 such as that shown in FIG. 5 will not permit any refrigerant to be removed from the inboard receiver tank 22, to cause an overpressure situation within the transfer tank 22 or the device 10.

Having described the invention in detail, and by reference to the preferred embodiments thereof, it will be apparent that modifications and variations are possible without departing from the scope of the invention as defined in the appended claims.

What is claimed is:

1. A device for recovering refrigerant from a refrigeration system, the refrigerant recovery device comprising:

a refrigerant processing flow path means including a withdrawing means for withdrawing refrigerant from the refrigeration system, and a processing means for processing the refrigerant so removed to remove impurities from the refrigerant, a receiver tank means for receiving and storing the processing refrigerant, the receiver tank means including an inlet and an outlet, a transfer means for permitting transfer of refrigerant from the receiver tank means to a transfer tank means only if the transfer tank means is at an initially evacuated condition, and for preventing transfer of refrigerant between the receiver tank means and the transfer tank means when a transfer tank means is not in an initially substantially evacuated condition.

2. The refrigerant recovery device of claim 1 wherein the transfer means includes a fluid flow path means for placing the receiver tank means in fluid communication with the transfer tank, and a pressure actuated valve means for controlling the flow of fluid in the fluid flow path means.

3. The refrigerant recovery device of claim 1 wherein the transfer means includes a pressure actuable valve means movable between an open position to permit the flow of fluid between the receiver tank means and the transfer tank means, and a closed position wherein the flow of fluid between the receiver tank means and the transfer tank means is prevented.

4. A device for recovering refrigerant from a refrigeration system, the refrigerant recovery device comprising:

a refrigerant processing flow path means including a withdrawing means for withdrawing refrigerant from the refrigeration system, and a processing means for processing the refrigerant so removed to remove impurities from the refrigerant, a receiver tank means for receiving and storing the processing refrigerant, the receiver tank means including an inlet and an outlet, a transfer means for transferring refrigerant from the receiver tank means to a transfer tank means at an initially evacuated condition, and for preventing the transfer of refrigerant between the receiver tank means and the transfer tank means when a transfer tank means is not in an initially substantially evacuated condition, the transfer means including a fluid flow path means for placing the receiver tank means in fluid communication with the transfer tank, and a pressure actuated valve means for controlling the flow of fluid in the fluid flow path means, a flow control means for permitting the vacuum induced by the initially substantially evacuated transfer tank means to actuate the pressure actuated valve means to place the receiver tank means in fluid communication with the transfer tank means, and for preventing the actuation of the pressure actuated valve means to prevent the receiver tank means and the transfer tank means from being placed in fluid communication when the transfer tank means is not in an initially substantially evacuated condition.

5. The refrigerant recovery device of claim 4 wherein the selective flow control means comprises a check valve means.

6. A device for recovering refrigerant from a refrigeration system, the refrigerant recovery device comprising:

a refrigerant processing flow path means including a withdrawing means for withdrawing refrigerant from the refrigeration system, and a processing means for processing the refrigerant so removed to remove impurities from the refrigerant, a receiver tank means for receiving and storing the processing refrigerant, the receiver tank means including an inlet and an outlet, a transfer means for transferring refrigerant from the receiver tank means to a transfer tank means at an initially evacuated condition, and for preventing the transfer of refrigerant between the receiver tank means and the transfer tank means when a transfer tank means is not in an initially substantially evacuated condition, the transfer means including a fluid flow path means for placing the receiver tank means in fluid communication with the transfer tank means, and a pressure transfer flow path means for placing the processing flow path means in fluid communication with the fluid flow path means.

7. The refrigerant recovery device of claim 6 wherein the transfer means includes a pressure actuated valve means having a first portion in fluid communication with the pressure transfer flow path means and a second portion in fluid communication with the fluid flow path means.

8. The refrigerant recovery device of claim 7 wherein the pressure actuable valve means is moveable between an open position to permit the flow of fluid between the receiver tank means and the transfer tank means, and a closed position wherein the flow of fluid between the receiver tank means and the transfer tank means is prevented.

9. The refrigerant recovery device of claim 8'wherein the pressure transfer flow path means includes a selectively actuable valve means for selectively placing the pressure transfer flow path means in fluid communication with the refrigerant processing flow path means when the device is in a recovery mode of operation, and a first one way valve means for preventing the backflow of fluid toward the selectively actuable valve means, the selectively actuable valve means and the one way valve means cooperable to allow fluid from the refrigerant processing flow path means to actuate the pressure actuable valve means to move to the closed position when the device is in a recovery mode of operation.

10. The refrigerant recovery device of claim 9 wherein the pressure transfer flow path means includes a second one way valve means in fluid communication with the fluid flow path means and with the pressure actuable valve means, the second one way valve means permitting fluid to flow therethrough to cause the pressure actuable valve means to be moved to its open position in response to the coupling to the device of a transfer tank means in a substantially evacuated condition, and preventing the flow of fluid therethrough to cause the pressure actuable valve means to remain in its closed position in response to the coupling to the device of a transfer tank means not in an initially substantially evacuated condition.

11. The refrigerant recovery device of claim 10 wherein the selectively actuable valve means comprises a three way valve means, the first one way valve means comprises a check valve means, and the second one way valve means comprises a check valve means.

12. A device for recovering refrigerant from a refrigeration system, the refrigerant recovery device comprising;

a refrigerant processing flow path means including a withdrawing means for withdrawing refrigerant from the refrigeration system, and a processing means for processing the refrigerant so removed to remove impurities from the refrigerant, a receiver tank means for receiving and storing the processing refrigerant, the receiver tank means including an inlet and an outlet, a transfer means for transferring refrigerant from the receiver tank means to a transfer tank means at an initially evacuated condition, and for preventing the transfer of refrigerant between the receiver tank means and the transfer tank means when a transfer tank means is not in an initially substantially evacuated condition, the transfer means including a pressure actuable valve means movable between an open position to permit the flow of fluid between the receiver tank means and the transfer tank means, and a closed position wherein the flow of fluid between the receiver tank means and the transfer tank means is prevented, a valve means in fluid communication with the pressure actuable valve means, the valve means permitting fluid to flow to cause the pressure actuable valve means to be moved to its open position in response to the coupling to the device of a transfer tank means in a substantially evacuated condition, and preventing the flow of fluid to cause the pressure actuable valve means to remain in its closed position in response to the coupling to the device of a transfer tank not in its initially substantially evacuated condition.

13. A device for recovering refrigerant from a refrigeration system, the refrigerant recovery device comprising:

a refrigerant processing flow path means including a withdrawing means for withdrawing refrigerant from the refrigeration system, and a processing means for processing the refrigerant so removed to remove impurities from the refrigerant, a receiver tank means for receiving and storing the processing refrigerant, the receiver tank means including an inlet and an outlet, a transfer means for transferring refrigerant from the receiver tank means to a transfer tank means at an initially evacuated condition, and for preventing the transfer of refrigerant between the receiver tank means and the transfer tank means when a transfer tank means is not in an initially substantially evacuated condition, the transfer means including a pressure actuable valve means movable between an open position to permit the flow of fluid between the receiver tank means and the transfer tank means, and a closed position wherein the flow of fluid between the receiver tank means and the transfer tank means is prevented, a selectively actuable valve means in fluid communication with the pressure actuable valve means, the selectively actuable valve means being actuable to allow fluid to flow to actuate the pressure actuable valve means to move to its closed position when the device is in a recovery mode of operation.

14. A device for recovering refrigerant from a refrigeration system, the refrigerant recovery device comprising:

a refrigerant processing flow path means including a withdrawing means for withdrawing refrigerant from the refrigeration system, and a processing means for processing the refrigerant so removed to remove impurities from the refrigerant, a receiver tank means for receiving and storing the processing refrigerant, the receiver tank means including an inlet and an outlet, a transfer means for transferring refrigerant from the receiver tank means to a transfer tank means at an initially evacuated condition, and for preventing the transfer of refrigerant between the receiver tank means and the transfer tank means when a transfer tank means is not in an initially substantially evacuated condition, the transfer means including a pressure actuable valve means movable between an open position to permit the flow of fluid between the receiver tank means and the transfer tank means, and a closed position wherein the flow of fluid between the receiver tank means and the transfer tank means is prevented, a first valve means for permitting the flow of fluid from the refrigerant processing flow path to the pressure actuable valve means to actuate the pressure actuable valve means to move to its closed position when the device is in a recovery mode of operation.

15. The refrigerant recovery device of claim 14 wherein the transfer means includes a second valve means in fluid communication with the pressure actuable value means, the second valve means permitting the flow of fluid to cause the pressure actuable valve means to be moved to its open position in response to the coupling to the device of a transfer tank means in an initially substantially evacuated condition, and preventing the flow of fluid to cause the pressure actuable valve to remain in its closed position in response to the coupling to the device of a transfer tank means not in its initially substantially evacuated condition.

16. In a refrigerant recovery device, a transfer means for transferring refrigerant from an inboard receiver tank of the refrigerant recovery device to an external transfer tank, the transfer means comprising:

a fluid flow path means through which fluid can flow between the receiver tank means and the transfer tank means, and a pressure actuable valve means disposed in the fluid flow path means for permitting the flow of fluid from the receiver tank means to the transfer tank means if the transfer tank means is at an initially substantially evacuated condition, and for preventing the flow of refrigerant between the receiver tank means and the transfer tank means if the transfer tank means is not in an initially substantially evacuated condition.

17. The invention of claim 16 wherein the transfer means includes a selectively actuable valve means in fluid communication with the pressure actuable valve means, the selectively actuable valve means being actuable to allow fluid to flow to actuate the pressure actuable valve means to move to a closed position when the device is in its recovery mode of operation.

18. The invention of claim 17 wherein the recovery device includes a refrigerant processing flow path means, and the selectively actuable valve means comprises a three way valve means in fluid communication with the refrigerant processing flow path means and the fluid flow path means to control the flow of fluid between the fluid flow path means and the refrigerant processing flow path means.

19. The invention of claim 16 wherein the transfer means includes a valve means in fluid communication with the pressure actuable valve means, the valve means permitting fluid to flow to cause the pressure actuable valve means to move to an open position in response to the coupling to the recovery device of a transfer tank means in an initially substantially evacuated condition, and preventing the flow of fluid to cause the pressure actuable valve means to remain in a closed position in response to the coupling to the recovery device of a transfer tank means not in an initially substantially evacuated condition.

* * * * *